United States Patent [19]

Kopp et al.

[11] Patent Number: 4,857,237

[45] Date of Patent: Aug. 15, 1989

[54] PROCESS FOR PREPARING REFINED OIL

[75] Inventors: Heinz-Peter J. Kopp, Brake, Fed. Rep. of Germany; Jannes G. Lammers, Maassluis, Netherlands; Jacob A. van der Wolk, Dordrecht, Netherlands; Willibrordus T. De Groot, Mijnsheerenland, Netherlands

[73] Assignee: Lever Brothers Company, New York, N.Y.

[21] Appl. No.: 92,013

[22] Filed: Sep. 2, 1987

[30] Foreign Application Priority Data

Sep. 8, 1986 [GB] United Kingdom ..... 8621614

[51] Int. Cl.[4] ..... C11B 3/16

[52] U.S. Cl. ..... 260/409; 260/428; 260/428.5

[58] Field of Search ..... 260/409, 428, 428.5

[56] References Cited

U.S. PATENT DOCUMENTS

| | | | |
|---|---|---|---|
| 2,365,045 | 12/1944 | Borkowski et al. | 260/409 |
| 2,602,807 | 7/1952 | Morris et al. | 260/409 |
| 2,650,931 | 9/1953 | Dron et al. | 260/409 |
| 2,654,766 | 10/1953 | Tausky | 260/409 |
| 2,783,260 | 2/1957 | Merker | 260/424 |

FOREIGN PATENT DOCUMENTS 2854949 7/1980 Fed. Rep. of Germany .

1531203 11/1978 United Kingdom .

OTHER PUBLICATIONS

"Fish Oils", by Stansby, Avi Publishing Company, 1967, p. 403.

"Oleagineux", 28, No. 7, (1973), pp. 355–359.

"Bailey's Industrial Oil and Fat Products", vol. 2, 4th Edition, John Wiley & Sons (1982), p. 37.

*Primary Examiner*—Werren B. Lone

*Assistant Examiner*—Vera C. Clarke

*Attorney, Agent, or Firm*—Milton L. Honig; James J. Farrell

[57] ABSTRACT

A process is provided for preparing refined oil comprising removal of nickel by incorporating an effective amount of an aqueous substance in crude oil and forming a dispersion containing water nickel and oil, and thereafter filtering the dispersion containing water, nickel and oil. As aqueous substance, for example liquid water, steam or dilute acid can be used. Small quantities of aqueous substance, usually less than about 4% calculated on the weight of the oil are sufficient. The process can be applied suitably, in particular in relation to hydrogenation of oil. The aqueous substance can suitably be incorporated in the oil before, during or after the hydrogenation reaction but before the filtration of the oil/catalyst slurry, or it can be incorporated after the slurry filtration, in the filtered hydrogenated oil.

17 Claims, No Drawings

PROCESS FOR PREPARING REFINED OIL

FIELD OF THE INVENTION

The present application relates to a process for preparing refined oil comprising removal of nickel.

BACKGROUND OF THE INVENTION

Unrefined and partially refined oil may comprise nickel that can be difficult to remove. In particular, oils and fats that have been hydrogenated with the use of a nickel-containing catalyst commonly still contain, after removal of the catalyst by filtration, a substantial amount of nickel. The nickel content of such filtered hydrogenated oils and fats may be as high as 50 or 100 ppm. These residual traces of nickel occur in the form of soap and/or as colloidal metal. For various reasons, e.g. to prevent oxidation, it is desirable for the nickel content of oils to be low, e.g. below 1 ppm. This is especially the case for oils to be used in edible products, in which oils the nickel content should preferably not exceed 0.1 ppm.

A variety of processes has been proposed as post-refining treatment of hydrogenated oil, in particular to remove residual nickel from filtered hydrogenated oil or to prevent the occurrence in oil of objectionable quantities thereof.

In U.S. Pat. No. 2,365,045 it is advised to add activated carbon to the oil before, during or after hydrogenation, but preferably before the hydrogenation. The free fatty acid content of the oil to be thus treated should preferably be not more than 0.05%. It is therefore considered to be desirable to employ as oil to be hydrogenated, an alkali-refined oil. After the hydrogenation, the mixture comprising the oil, the catalyst and the carbon, which may or may not have been present during the hydrogenation, is filtered to recover the hydrogenated oil. The addition of the sorptive material serves to facilitate the removal of colloidally suspended nickel particles and to absorb soaps.

According to U.S. Pat. No. 2,602,807, the removal of nickel catalyst from hydrogenated oil by incorporating bleaching clay in the oil and filtering the mixture obtained, can be improved by employing acid-activated clay. The clay may be added to the oil/catalyst slurry or it may be added to the oil from which the major part of the catalyst has already been removed by filtration. The process can, for example, be carried out by, prior to filtration, first adding a small amount of concentrated phosphoric acid or sulphuric acid to ordinary bleaching clay and then adding the thus acidified clay to the oil or by adding both acid and bleaching clay to the oil.

U.S. Pat. No. 2,650,931 advises, in order to remove residual metal contaminants from filtered hydrogenated oil, to intimately mix the oil with an aqueous solution of an acid in which the metallic salts are soluble, and to subject the resulting mixture to a centrifuging operation in which the aqueous acid solution is centrifugally separated from the cleaned oil. Suitably a diluted aqueous solution of, for example, citric acid, phosphoric acid or tartaric acid is employed in an amount of about 10% of the amount of oil.

In U.S. Pat. No. 2,654,766 a number of treatments are proposed to obtain suitable hydrogenation results:

The hydrogenation is carried out in the presence of lignin, which is said to allow better separation of nickel traces in the filtered hardened fat due to the inactivation of nickel soaps which are said to be usually formed in the course of hydrogenation using a nickel catalyst.

According to the specification, the formation of nickel soap can be substantially reduced by subjecting the oil to a pretreatment wherein the oil is heated to above 100° C. under hydrogen pressure in the presence of a small amount of spent metal catalyst, e.g., spent nickel catalyst. Improved results are said to be obtainable by carrying out this heat pretreatment in the presence of a small amount of activated bleaching earth and preferably also of activated carbon and filtercel.

The thus pretreated and filtered oil may subsequently, prior to hydrogenation, be subjected to treatment with phosphoric acid and/or sodium phosphate so as to separate metal soaps. This treatment is carried out by heating the oil with a diluted aqueous acidic solution, allowing the mixture to settle and removing the aqueous soap-containing sludge. Subsequently, the oil may be filtered with a small amount of filtercel, or, alternatively, to remove free acidity, the oil may be sprayed with a caustic soda solution, followed by repeated washing with hot water to remove traces of soap.

A similar treatment with a diluted solution of phosphoric acid and sodium phosphate may be applied after the hydrogenation to remove, e.g., nickel soaps. This treatment may be followed by a treatment with about 0.01–0.02% organic acid such as oxalic acid, citric acid or acetic acid to remove iron traces. Subsequently, for example activated clay can be added to effect bleaching of the oil and/or the oil can be deodorised, to complete the refining procedure.

In U.S. Pat. No. 2,783,260, a process is described for removing hydrogenation odours and flavours from fatty oils, comprising adding about 0.5–4% concentrated phosphoric acid to the hydrogenated oil, maintaining the mixture with agitation at about 60°–95° C. while injecting air therein, subsequently adding a neutral bleaching earth and maintaining the resulting mixture at about 130°–140° C. and then cooling and filtering the mixture. The oil to be thus treated should not have a free fatty acid content higher than 0.1%. Oil having a free fatty acid content above 0.1% should first be subjected to alkali refining, before applying the treatment with phosphoric acid, air and bleaching earth.

In Fish Oils, edited by M. E. Stansby, published by the Avi Publishing Company, Inc. in 1967, p. 403, it is described how to subject filtered, hydrogenated fish oil to a post-refining process comprising treating the oil with 0.1N caustic soda solution, washing it three times with hot water, and then vacuum-drying it at 95° C. Subsequently, the oil is bleached with activated earth and deodorised by injection of superheated steam under reduced pressure.

Similarly, Oléagineux, 28 N° 7, (1973), pp. 356–359, describes the treatment of crude hardened oil, after filtering it, with a dilute alkali wash, followed by a hot water wash, and then by drying of the oil, addition of earth, filtering and deodorising. If continuous centrifugal equipment is employed, the hot water wash step may be omitted. Alternatively, it is said that, especially in the case of hardened vegetable oils, the alkali neutralisation may be omitted and the oil may be post-refined by merely adding a small amount of activated earth before filtering a second time, and then stripping the oil to cause deodorisation and removal of free fatty acids. To protect the oil against oxidation, it is suggested to add metal sequestrants such as citric acid at any convenient time after filtering and suitably at the beginning of the deodorisation.

In GB No. 1,531,203 it is stated that filtered, hydrogenated organic liquids, e.g., oils, often contain residual amounts of metal hydrogenation catalysts which must be removed by subsequent steps which are usually termed "post-bleaching", where the residual traces of the metal catalyst are removed through the use of neutral scavengers of compounds capable of forming inactive complexes with the metal component. These materials include certain acids such as phosphoric acid and organic acids such as citric acid and tartaric acid. The post-bleaching treatment requires additional filtration with addition of e.g. Filteraid ®. As an alternative way of post-refining hydrogenated oil, GB No. 1,531,203 teaches to subject hydrogenated oil in admixture with a finely divided dispersed solid absorbent, in the absence of oxygen, to electrofiltration. Alternatively, the absorbent may be admixed prior to the hydrogenation reaction.

In DOS No. 2,854,949 it is proposed to remove nickel particles from hydrogenated oil by passing the oil through a magnetic field.

According to Bailey's Industrial Oil and Fat Products (Volume 2, fourth edition, John Wiley & Sons, p. 37 (1982)), removal of residual nickel, occurring in filtered hydrogenated oil in the form of soap or colloidal metal, is usually accomplished by a so-called post-bleaching step, in which the filtered oil is treated with 0.1–0.2% of bleaching earth at about 180° F. (82.2° C.) and filtered. A very small amount of phosphoric acid or other metal scavenger is sometimes added in the bleaching step. It is stated that, alternatively, activated carbon can be used, which is added to the oil along with the catalyst prior to hydrogenation. Carbon in an amount equal to 10–20 times the amount of nickel in the catalyst is reported to yield a metal-free filtered oil.

Thus, a large variety of processes has been proposed to achieve an acceptably low residual nickel content in hydrogenated oil. However, various disadvantages are attached to these processes. Despite all the attention devoted to solving this problem, no entirely satisfactory solution has been found.

Firstly, not all proposed processes have the desired effect of substantially reducing the residual nickel content or preventing the occurrence of an objectionably high nickel content. For example, the effect on the nickel content of filtered hydrogenated oil of washing the oil with diluted aqueous solutions, is limited.

Processes wherein an absorbent is admixed with the oil/catalyst slurry, whether added before, during or after the hydrogenation, prior to the filtering, have the disadvantage that the catalyst that is retrieved from the filtration is diluted with the spent absorbent. This affects the possibilities of re-using the catalyst in subsequent hydrogenations. Moreover, the increasing quantities of catalyst-absorbent mixture that need to be employed when re-using the mixture repeatedly, cause a corresponding increase of oil loss at the filtration.

Several of the above-described processes employ diluted aqueous solutions, in particular diluted aqueous acidic solutions. In these processes the oil is subjected to a so-called washing treatment, i.e. a relatively large amount of the aqueous solution, e.g. about 10 wt. % calculated on the oil, is admixed with the oil. The mixture may then, for example, be given a residence time or be heated. Subsequently, an aqueous phase containing contaminants is separated off and refined oil is recovered by means of gravitational force, e.g. by centrifugal separation or by draining the aqueous contaminants-containing phase from the bottom of the vessel. Such treatment is often followed by one or more washing steps with hot water.

Apart from the fact that such processes often do not adequately reduce the nickel content, it is a major disadvantage that these treatments produce large quantities of effluent.

A further group of processes that can be distinguished in the prior art consists of the ones in which the oil is treated with chemical reagents, other than adsorbents, but in which no large amounts of aqueous solutions are employed. These processes do not have the disadvantage of producing large volumes of aqueous effluent. As described above, in these processes concentrated acids, e.g. phosphoric acid, citric acid or sulphuric acid, are employed, and the chemical substance added to the oil contains only a small proportion of water or practically no water at all. When using such substances, there is a substantial risk of corrosion. Consequently, corrosion-resistant equipment, e.g. stainless steel equipment, must be used for handling these substances. Moreover, when using such aggressive chemical reagents, the risk of undesired side reactions occurring, e.g. hydrolysis of the oil, is substantial.

Some of the processes described above are very expensive. For example, the required investments for installing a magnet or an electrofilter with factory-scale capacity are very high.

SUMMARY OF THE INVENTION

It has now been found that these problems can be overcome and that the nickel content of oil can be reduced substantially in a simple and convenient manner, without the need to use chemical reagents and without producing large volumes of effluent.

Accordingly, the present invention provides a process for preparing refined oil comprising removal of nickel, by incorporating an effective amount of an aqueous substance in crude oil and forming a dispersion containing water, nickel and oil, and thereafter filtering the dispersion containing water, nickel and oil.

DETAILED DESCRIPTION

The term crude oil is used to indicate the oil in which the aqueous substance is incorporated. The word crude does not imply that the oil is not refined. The crude oil may, in fact, be completely refined oil, for example triglyceride oil that is suitable for human consumption, but that is yet to be further treated, for example to be hydrogenated. The crude oil, at the time the aqueous substance is incorporated, may or may not contain nickel. For example, as will be further elucidated below, it can be advantageous to incorporate the aqueous substance in oil, which may have been neutralised, bleached and deodorised but which is yet to be hydrogenated with a nickel-containing catalyst, before the start of the hydrogenation reaction. The aqueous substance may then be incorporated in the oil before or simultaneously with the addition of the catalyst. Alternatively, the crude oil may, for example, be hydrogenated oil from which the major part of the nickel-containing catalyst has already been removed by filtration of the oil/catalyst slurry, but of which the residual nickel content is too high, in view of the intended use of the hydrogenated oil.

It is an advantage of the present process that it can be carried out without using aggressive chemical reagents. Consequently, the risk of corrosion occurring can be prevented and mild steel equipment can be used. The process can be successfully applied to remove nickel from fatty oil, also when that oil includes a considerable amount of free fatty acids, e.g. As much as 1% or even more, thereby allowing the free fatty acids to be removed in a subsequent steam-stripping treatment. No sophisticated equipment is required to carry out the present process and the process is comparatively cheap.

Because the present process provides a way of removing finely dispersed nickel in an acceptable manner, it allows the use of catalyst with very small particle sizes. This is an advantage because, with such catalysts, relatively high selectivity and activity can be achieved.

It is another advantage of the present process that it relies on physical phenomena. No chemical reagents need to be employed and, thus, the risk of undesirable side reactions occurring, which may result in the formation of unpredictable chemical compounds, can be avoided. We do not wish to be bound by the theory, but we believe that the nickel removal in the present process occurs by the action of aqueous liquid causing the otherwise colloidal nickel to form agglomerates that can be removed by filtering. The aqueous liquid need not consist of pure water; it may contain dissolved or dispersed therein other substances, provided such substances do not adversely affect the capability of the liquid to wet the colloidal nickel particles and cause them to agglomerate. Whereas the particle size of the colloidal nickel is too small to allow the removal from the oil by filtration, the agglomerates consisting essentially of aqueous liquid and nickel particles are sufficiently large to be capable of being separated from the oil by filtration. Only very small amounts of aqueous liquid are required to bring about nickel agglomeration, and useful results can be obtained with the addition of, for example, 0.1% on the weight of the oil, or even less. Useful results can, however, only be obtained if the aqueous liquid indeed contacts the nickel particles and wets them, as a first stage in the agglomeration. Consequently, such small quantities can only be effective if the aqueous liquid is dispersed sufficiently thoroughly to bring about such contact between the aqueous liquid and the colloidal nickel particles. Adequate contact between colloidal nickel particles and aqueous liquid can be obtained more easily if larger amounts of aqueous liquid are employed and, accordingly, less attention needs to be paid to the quality of the dispersing operation. Although, in principle, there is no upper limit to the amount of aqueous liquid that can be employed to form the nickel agglomerates, in practice it is usually not useful to employ more than about 2–4% aqueous liquid, calculated on the weight of the oil. When using such relatively high amounts of aqueous liquid, we believe, three kinds of water can be distinguished in the system: water dissolved in the oil, water contained in the agglomerates and so-called free water, water contained in aqueous droplets occurring in the oil. (As will be described below, an absorbent may be employed in the present process. In that case, a fourth kind of water can be identified, namely water absorbed onto the absorbent.) The amount of water dissolved in the oil depends on the compositions of the oil and the aqueous substance employed, on the temperature, the pressure etc. If the system contains free water, this may cause problems in the subsequent filtration. Although filters exist that are not adversely affected by the presence of free water, the most commonly used filters get clogged when used for filtering oil containing free water. Consequently, when using such common filters and aqueous substance in such large amounts that the dispersion to be filtered contains free water, the dispersion should preferably be dried to remove such free water to allow carefree filtration. This problem cannot, we found, be solved adequately by simply employing a larger amount of aqueous substance and effecting the separation, not by filtering, but by some sort of gravitational separation such as centrifuging. We found that the use of such washing procedures did not result in satisfactory nickel removal.

The problem of residual nickel in oil that cannot be removed adequately by ordinary filtration mainly occurs with hydrogenated oil. Accordingly, the present process is preferably applied to remove nickel from hydrogenated oil. Such difficultly removable nickel does not normally occur in unhydrogenated oil, but if somehow such oil has become contaminated with nickel, the present process can suitably be employed to refine it.

Throughout this specification the terms oil and fat are used interchangeably, and they are meant to indicate fatty oils, such as glyceride oils consisting mainly of triglycerides, and other fatty oils, e.g. jojoba oil, and synthetic oils, e.g. poly fatty acid esters of mono- and disaccharides and the like. The present process is preferably employed for the preparation of refined edible oils, in particular of refined edible glyceride oils.

Examples of oils which can suitably be hydrogenated with the use of a nickel catalyst, and for which the present process can beneficially be employed to remove nickel, include soyabean oil, rapeseed oil, palm oil, palmkernel oil, cottonseed oil and sunflower oil and oil mixtures comprising these oils.

The present process is particularly applicable to hydrogenated fish oil. Not only are large amounts of fish oil subjected to hydrogenation, but the effective removal of nickel catalyst from fish oil is a well-known problem. One known approach to solve this problem is to try and prevent the occurrence of a high residual nickel content in the filtered hydrogenated oil by subjecting the oil to an extensive refining treatment before the hydrogenation. An alternative approach, widely used to date, has been alkali treatment of the filtered oil/catalyst mixture followed by bleaching and deodorisation. The alkali treatment could also have the effect of neutralising any free fatty acids present. By use of the present process, it is neither necessary to apply an extensive pre-treatment nor to apply the alkali treatment. Any free fatty acids in the fish oil can be removed by steam-stripping, thus avoiding, inter alia, the need to dispose of soap stock.

The aqueous substance employed in the present process preferably consists essentially of water. The amounts of other materials that may be present in the aqueous substance without adverse effects depend on the nature of the substances involved. For example, relatively large quantities of lower alcohols can be tolerated in the aqueous substance. In practice, however, the aqueous substance comprises preferably at least 80 wt. % water, more preferably at least 90 wt. %, a water content of at least 95 wt. % in the aqueous substance being particularly preferred.

It can be beneficial to employ an aqueous substance that contains some acid. Preferably an aqueous substance consisting of water and acid, preferably edible acid, that contains practically no other ingredients, is employed.

For example, a citric acid solution of 5 or 10 wt. % strength can be employed. For use with edible oils, a non-toxic acid should be employed. Acid solutions of up to 20 wt. %, preferably up to 10 wt. %, can be employed. We believe that the action of the acid is merely in aiding the agglomeration of the colloidal nickel, possibly by removing any soaps adhering to the nickel particles which might hinder agglomeration.

If the crude oil to be treated is oil that has been hydrogenated with a nickel catalyst, then the aqueous substance can be added to and dispersed in the slurry comprising hydrogenated oil and catalyst, before removal of the catalyst by filtration. Alternatively, the aqueous substance can be dispersed in the filtered hydrogenated oil, from which, thus, the major part of the nickel catalyst has already been removed.

According to another preferred embodiment, the present invention comprises a process including hydrogenating oil with the use of a nickel-containing catalyst, stopping the hydrogenation and recovering refined oil by filtering the slurry comprising hydrogenated oil and catalyst, wherein aqueous substance is incorporated in the crude oil before or during the hydrogenation. We have found this procedure to be particularly advantageous if the oil to be hydrogenated is very dry, for example if the water content of the oil is less than about 0.05 wt. %. This may, in particular, be the case if the oil to be hydrogenated has been steam-stripped or deodorised, i.e. treated with steam at high temperature and low pressure. In such dry oil there is a substantial risk of dissolution of catalyst in the oil occurring. The aqueous substance may be incorporated during the hydrogenation, but it is more convenient to do so before the start of the hydrogenation reaction. Preferably the aqueous substance is incorporated in the crude oil, before or substantially simultaneously with the addition of the nickel-containing catalyst thereto. This embodiment of the invention can in particular be advantageously employed if the hydrogenation is carried out in equipment that is evacuated after the reaction has been terminated, because of which the addition of, for example, steam after the hydrogenation but before filtration of the oil/-catalyst slurry may be inconvenient. In such a case, the addition of aqueous substance, for example, together with the catalyst has a beneficial effect on the nickel content of the filtered hydrogenated oil ultimately obtained, despite the fact that, after the reaction has been stopped, the dispersion containing oil, nickel catalyst and aqueous substance is kept under vacuum.

Thus, in relation to a hydrogenation reaction, the incorporation of aqueous substance in crude oil according to the present process, may be effected before the start of the hydrogenation reaction, e.g. before or essentially simultaneously with the addition of the hydrogenation catalyst to the oil, during the hydrogenation, after the hydrogenation reaction has been stopped but before the filtration of the oil/catalyst slurry, or after that filtration has been carried out. In the cases in which the incorporation of aqueous substance is effected before filtration of the slurry of hydrogenated oil and catalyst, that filtration step acts as the filtration of the dispersion containing water, nickel and oil required in the present process. If the aqueous substance is incorporated in the filtration hydrogenated oil, then a further filtration step is required. Usually, filtered hydrogenated oil is subsequently treated with an absorbent, e.g. bleaching earth. As will be further elucidated below, the filtration of the dispersion containing water, nickel and oil can suitably be combined with the separation of the absorbent from the oil. An advantage of the embodiment of the present invention wherein the aqueous substance is incorporated before filtration of the oil/-catalyst slurry is that the nickel content of the filtered hydrogenated oil is very low As a consequence, the nickel content of e.g. bleaching earth that has been used to bleach the hydrogenated oil and that has to be disposed of, is low. This is an advantage because the disposal of spent bleaching earth with a high nickel content, causes environmental problems.

In a preferred embodiment of the present process, the aqueous substance that is contacted with the crude oil, is steam. With the use of steam, a very thorough dispersal of the aqueous substance in the oil can be obtained conveniently and substantial removal of nickel can already be achieved when employing steam in an amount of only about 0.1–0.2% by weight of the oil.

It is particularly preferred to employ steam as aqueous substance being incorporated if, as crude oil, a hydrogenated oil/catalyst slurry is employed before removal of the catalyst therefrom by filtration. When using steam, adequate dispersal of the aqueous substance can be achieved without the use of vigorous stirring. The use of vigorous stirring to aid the dispersal of the aqueous substance in an oil/catalyst slurry might well cause the formation of large quantities of very small, finely dispersed catalyst particles, especially when the usual supported catalyst has been employed. Such formation of fines due to mechanical damage of the catalyst particles, which makes the subsequent filtration more difficult and increases the content of nickel that cannot be removed by filtration, can be avoided when using steam as aqueous substance, which can be adequately dispersed without such vigorous mechanical stirring. Preferably, the slurry comprising oil, catalyst and aqueous substance is subjected to relatively mild agitation only, for example with the use of a suitable mixing device, e.g. As is often present in common hydrogenation equipment.

In another preferred embodiment of the present process, an aqueous liquid is contacted with the oil and the resulting composition is mixed. With the use of mechanical mixers and/or stirrers, the aqueous liquid can be adequately dispersed in the oil. This embodiment of the process is in particular suitable for the refining of filtered hydrogenated oil.

The present process can suitably be applied repeatedly. For example, to obtain hydrogenated fish oil with a low residual nickel content, the present process can suitably be applied by treating the oil/catalyst slurry with about 0.1–0.2 wt. % of steam, filtering the resulting dispersion and then applying the present process once more with an adequate amount of aqueous liquid.

With the present process worthwhile removal of nickel can be obtained when applied to oil/catalyst slurries as well as to filtered hydrogenated oils and other oils having a nickel content as high as 200 ppm or as low as 0.1 ppm nickel, expressed on the weight of the oil. In the latter case, the crude oil to be refined with the present process preferably contains 0.2–100 ppm nickel, more preferably 0.3–50 ppm nickel.

In practice, the amount of aqueous substance employed in the present process is from 0.01 to 4% by weight of the oil. The amount of aqueous substance used is preferably 0.05–2%, more preferably 0.1–1% by weight of the oil.

In the aqueous substance is incorporated in oil to be hydrogenated or while it is being hydrogenated, then the amount of aqueous substance incorporated is preferably such that the total water content of the oil does not exceed 0.2 wt. %, preferably not 0.15 wt. %, because otherwise adverse interaction with the catalyst may occur. When dry oil is to be hydrogenated, usually advantageous effects can be achieved in particular by incorporating about 0.05–0.1 wt. % of steam before or during the hydrogenation. When dry oil is to be hydrogenated, it can furthermore be advantageous to incorporate some aqueous substance before or during the hydrogenation and further aqueous substance after the hydrogenation reaction has been stopped but before the oil/catalyst slurry is filtered to remove the catalyst and recover refined oil. For example, 0.1 wt. % liquid water may be incorporated in dry oil simultaneously with the addition of the catalyst, 0.2 wt. % steam further being incorporated prior to the slurry filtration.

Optimal results can be obtained (except in the case that the aqueous substance is added to crude oil that is being or yet to be hydrogenated, as described above) when the amount of water dispersed in the oil is close to, in particular slightly above the solubility of water in the oil under the prevailing circumstances. Accordingly, it is preferred that the amount of water dispersed in the oil is at least about equal to the solubility of water in the oil, but is less than 0.5% by weight of the oil above that solubility. The amount of aqueous substance to be added to the oil to achieve this, depends inter alia on the composition of the aqueous substance employed, the amount of water already contained in the crude oil to be treated and the temperature.

The temperature at which the process is carried out is not critical. The preferred temperature range for performing the present process if 60°–100° C., but higher temperatures can also be employed. When using ordinary water as aqueous substance, then the solubility in the oil at 60°–100° C. ranges from about 0.2 wt. % to about 0.4 wt. %. For example, at 90° C. the solubility of water in common filtered hydrogenated glyceride oil is about 0.37 wt. %.

Although, generally, the preferred temperature range for carrying out the present process is 60°–100° C., it can be advantageous to employ higher temperatures when the crude oil to be treated is a hydrogenated oil/catalyst slurry. If the present process is to be applied to improve the removal of catalyst in the filtration of the oil- and catalyst-containing slurry by incorporating the aqueous substance, after the hydrogenation, in the oil/catalyst slurry, then the aqueous substance is preferably introduced into the slurry at about 120°–220° C., more preferably at about 150°–190° C. This is preferably done by dispersing the aqueous substance, preferably steam, in the oil/catalyst slurry while the slurry is being cooled down after completion of the hydrogenation reaction. Conveniently, the steam is introduced into the crude oil while the oil/catalyst slurry is still in the hydrogenation vessel, or, in case a drop tank is applied, in the drop tank.

The contact time between the water and the oil is not very critical. In practice, after introduction of the aqueous substance into the oil and before the filtration, the dispersion is conveniently maintained for between 1 second and 1 hour, or even longer, with agitation. (If the aqueous substance is incorporated in crude oil before or during its hydrogenation, in view of the time required to achieve the desired extent of hydrogenation, substantially longer contact times may be applied.)

The desirable maintenance time is determined in particular by the way in which the dispersion is formed. If this is done in a way in which thorough dispersal is achieved rapidly, then the maintenance time can be very short. For example, if steam is employed as aqueous substance, then the dispersion can be passed to the filter stage essentially immediately after introduction of the steam into the oil, thus providing for a residence time about equal to the transport time, which may be just a few seconds. Alternatively, if aqueous liquid is added to the oil and only mild agitation is applied, e.g. relatively slow stirring, then it may take a considerable period of time before the aqueous liquid and nickel have been brought into contact sufficiently to allow adequate formation of agglomerates, and it may consequently be desirable to maintain the dispersion with agitation for as long as half an hour or even longer. When using a liquid aqueous substance, but with more vigorous stirring, then correspondingly shorter maintenance times can be used suitably. Preferably, however, the contact time of crude oil and aqueous substance is at least about 15 minutes, also in case steam is applied as aqueous substance.

In the present process, particularly in case the crude oil is filtered hydrogenated oil, preferably an adsorbent is admixed with the dispersion prior to the filtration. In a preferred embodiment, the adsorbent is activated carbon. In another preferred embodiment, the adsorbent is bleaching earth, preferably acid-activated bleaching earth. The adsorbent may also comprise both activated carbon and bleaching earth.

The amount of adsorbent is preferably about 0.01–2% by weight of the oil, more preferably 0.05–1% by weight of the oil.

The actual amount employed may be chosen in dependence upon the amount of water added and the amount of nickel to be removed. As mentioned above, the presence of free water in the dispersion to be filtered can cause problems. Adsorbents such as bleaching earth commonly can bind up to their own weight of water. Thus, if just a small amount of free water is present, in addition to the water dissolved in the oil and the water contained in the nickel agglomerates, then the free water can effectively be removed from the system, to prevent filtration problems, by incorporating some bleaching earth in the dispersion.

The suitable amount of adsorbent to be employed depends also on the desired extent of bleaching. Thus, for oils with a relatively dark colour, a larger amount of bleaching clay or other adsorbent is adequate than for oils already having a light colour.

The presence of adsorbent in the dispersion may further facilitate the subsequent filtration.

To achieve adequate bleaching and adsorption of water, the dispersion comprising water, nickel, oil and adsorbent preferably is maintained with agitation for between 5 and 30 minutes. Longer or shorter contact times may, however, be appropriate in some circumstances.

Whether or not an adsorbent is employed, the dispersion including oil, nickel and water, that is filtered, preferably contains no free water. Free water may be present in the dispersion even though the total water content of the dispersion may be less than the solubility of water in oil under the prevailing circumstances. In this case the free water can disappear by maintaining the dispersion sufficiently long to allow the free water to dissolve in the oil, but in practice it may be more convenient to remove the free water by other means, e.g. with an adsorbent.

A preferred way to remove free water is by drying the dispersion to remove part of the water contained therein. We believe that, when drying the dispersion, first the free water evaporates and subsequently evaporation of dissolved water from the oil occurs. The water in the agglomerates is the most stable and, consequently, in practice in risk of the agglomerates falling apart again, owing to the removal of water therefrom during the drying, is negligible. Drying of the dispersion can also be suitable when an adsorbent is employed. Then the drying is suitably carried out after incorporation of the adsorbent. In practice, bleaching is commonly carried out under a partial vacuum at elevated temperatures. Under these circumstances, drying of the dispersion occurs during the bleaching without extra measures having to be taken.

Any suitable filtering means may be employed. Examples of suitable filters include filter paper, filter sieves, suitably operated under the applied pressure. A preferred way of filtering the dispersion including water, nickel and oil is by means of microfiltration, preferably crossflow microfiltration. Another preferred way to carry out the filtration is by means of a plate and frame filter. Especially if no adsorbent is applied, it can be advantageous to incorporate some filter aid in the dispersion to be filtered, to facilitate the filtration.

The present process preferably includes the further step of subjecting the oil to a steam stripping procedure, for example under a reduced pressure between 12 and 2 mbar. Such a step not only has the effect of deodorising and, if appropriate, decolouring the oil, but it can also be to remove free fatty acids from the oil.

Embodiments of the present invention will now be described by way of example only, with reference to the following examples.

In the following examples, except where otherwise indicated, weight measurements are percent weight measurements with respect to the oil.

EXAMPLE 1

Nickel catalyst used to hydrogenate a fish oil to a slip melting point of 37° C. was substantially removed by passing the oil through a plate and frame filter. The resulting oil contained, however, 4 mg Ni/kg oil. The nickel content was determined with atomic absorption spectroscopy.

This oil was heated to 90° C. under vacuum. The vacuum was then broken by nitrogen admission. 1 wt. % with respect to the oil of distilled water was added to the oil and the resulting mixture stirred for 30 minutes under nitrogen. The power input was 6 kW per ton. 1 wt. % of Tonsil Standard FF ® (a mildly acid-activated bleaching earth) was added to the mixture and maintained in contact with the oil for 30 minutes under nitrogen with stirring. The mixture was then dried at 90° C. for 10 minutes under a pressure of 0.1 bar and then filtered at 90° C. over an Orion ® plate and frame filter containing as filter medium Seitz ® paper filter plates (Supra 1500 code 4915) under nitrogen pressure at 4 bar. The resulting nickel content of the oil was found to be 0.02 mg Ni per kg oil.

The bleaching oil was then subjected to deodorisation at 200° C. with 2.5% per hour stripping steam and a headspace pressure of about 4 mbar for about 4 hours.

Using the same procedure, a starting material containing 25 ppm (by weight) nickel was similarly treated, bleached and deodorised. The bleached oil contained 0.05 ppm Ni.

EXAMPLE 2

Fish oil samples from the same batches as employed in Example 1, containing respectively 4 and 25 mg/kg nickel, were subjected to the same procedures as described in Example 1, with the exception that 1 wt. % of a 10 wt. % aqueous citric acid solution was employed in place of the 1 wt. % water. The resulting nickel content of the bleached oils was <0.01 and <0.02 mg/kg, respectively.

As a comparative experiment to the procedures described in Examples 1 and 2, the same oils were subjected to the procedures described above, with the exception that no water or citric acid solution was employed, i.e. The fish oils were subjected to bleaching earth only prior to deodorisation. The bleached oils contained about 0.4 and 0.6 mg/kg Ni, respectively.

The results of the experiments described in Examples 1 and 2 of the comparative experiment are tabulated in Table I below.

TABLE I

| Ni in starting fish oil (ppm) | Solution added | Ni in bleached oil (ppm) |
|---|---|---|
| 4 | 1 wt. % water | 0.02 |
| 4 | 1 wt. % of 10 wt. % citric acid solution | <0.01 |
| 4 | nil | ~0.4 |
| 25 | 1 wt. % water | 0.05 |
| 25 | 1 wt. % of 10 wt. % citric acid solution | <0.02 |
| 25 | nil | ~0.6 |

EXAMPLE 3

Using the procedure described in Example 1, a fish oil hydrogenated to a slip melting point of 37° C. containing after conventional filtering 6 mg/kg nickel was treated with water, bleaching and deodorised. The resulting oil was then stored in the dark at 20° C. for several weeks and subjected at intervals to tasting tests.

As a comparison, the same starting oil was subjected to a conventional procedure comprising neutralising the oil by additional aqueous sodium hydroxide, carbonate and silicate, boiling the mixture at 105° C. for 40 minutes, cooling to 95° C., washing the oil twice with 10% hot water to a soap content of <0.1%, drying, bleaching with 0.5 wt. % Tonsil Standard FF for 20 minutes at 90° C. and filtering. The oil was then deodorised under the same conditions as described in Example 1. The resulting oil was subjected to the same storage and testing procedure.

The results are given in Table II below

EXAMPLE 4

Using the procedure described in Example 2 above, fish oils hydrogenated to a slip melting point of 37° C. containing, after filtering, respectively 0.4, 1.0 and 7 mg/kg nickel, were treated with dilute citric acid solution, bleaching and deodorised and then stored at 20° C. in the dark and subjected to tasting tests.

As a comparison, in each case the neutralisation/bleaching/deodorisation procedure as described in Example 3 was performed. The resulting oils were subjected to the same storage and tasting procedures as applied to the oils treated with citric acid solutions.

The results are given in Table II below.

TABLE II

| Example | Ni in starting oil (ppm) | Ni in refined oil (ppm) | Tasting score* after 0 weeks | 6 weeks | 8 weeks | 12 weeks |
|---|---|---|---|---|---|---|
| 3 | 6 | <0.02 | 6.4 | 6.5 | 5.9 | — |
| Comp. 3 | 6 | 0.04 | 6.4 | 6.5 | 5.9 | — |
| 4 | 0.4 | <0.01 | 5.7 | 5.8 | — | 5.8 |
| Comp. 4 | 0.4 | <0.01 | 5.7 | 5.6 | — | 5.8 |
| 4 | 1.0 | 0.02 | 6.3 | 6.5 | 5.7 | — |
| Comp. 4 | 1.0 | 0.03 | 6.1 | 5.3 | 5.4 | — |
| 4 | 7 | <0.02 | 6.2 | 5.8 | — | 5.7 |
| Comp. 4 | 7 | <0.02 | 6.0 | 5.5 | — | 5.3 |

*A higher score indicates a better taste: 7 indicates a bland taste, 4 indicates a very strong off-flavour.

EXAMPLE 5

A series of experiments was performed on a batch of fish oil hydrogenated to a slip melting point of 37° C. which had been passed through a plate and frame filter to reduce its nickel content to 25 mg Ni per kg oil.

In each experiment the fish oil was heated under vacuum to 90° C. The vacuum was released under nitrogen and a varying amount of water added in each experiment. The water was stirred with the oil for 30 minutes using a stirring rate of 7 sec.$^{-1}$ (power dissipation 6 kW/ton). Still at 90° C., the oil was contacted with 1 wt. % acid-activated bleaching earth (Tonsil Standard FF®) for 30 minutes. Subsequently, each oil mixture was dried at 0.1 bar for 10 minutes. The resulting slurry was then filtered at a constant pressure of 4 bar through a 0.01 m$^2$ test filter covered with a cotton cloth type 0027-2/2 TWILL® (a coarse cloth which requires a pre-coat for proper filtration, which pre-coat is formed by the earth) on a support weave.

The varying amounts of water employed were 0, 0.3, 0.5, 1 and 1.37 wt. % with respect to oil. The results in terms of final nickel content in the oil are given in Table III below.

TABLE III

| % water added | Ni (mg/kg) |
|---|---|
| 1.37 | 0.05 |
| 1.0 | 0.05 |
| 0.5 | 0.01 |
| 0.3 | 0.5 |
| 0.0 | 0.6 |

EXAMPLE 6

A further series of experiments was performed on the same batch of hydrogenated fish oil as employed in Example 5.

The same procedure as in Example 5 was followed, with the exception that in each case 1 wt. % water was added to the oil, the contact time of water and oil was 5 minutes and the contact time of oil, water and bleaching earth was varied, times of 1, 5, 15 and 30 minutes being employed. The results in terms of nickel content of the filtered oil are given in Table IV below.

TABLE IV

| Contact time with bleaching earth (minutes) | Ni (mg/kg) |
|---|---|
| 30 | 0.02 |
| 15 | <0.05 |
| 5 | 0.02 |
| 1 | 0.07 |

EXAMPLE 7

Using the samples of fish oil from the same batch as that employed in Example 5, a further series of experiments was performed.

The same procedure as described in Example 5 was followed, with the exception that the amount of water added was constant at 1 wt. % and the contact times of water with the oil were varied, the times employed being 1, 5, 15, 30 and 60 minutes. The results in terms of the nickel content of the filtered oil are given in Table V below.

TABLE V

| Contact time with water (minutes) | Ni (mg/kg) |
|---|---|
| 60 | <0.01 |
| 30 | <0.05 |
| 15 | <0.01 |
| 5 | <0.01 |
| 1 | <0.01 |

EXAMPLE 8

Using samples of fish oil from the same batch as that employed in Example 5, a further series of experiments was performed. The procedure of Example 5 was followed, with the exception that the amounts of water and bleaching earth added were varied. The amounts of bleaching earth and water employed and the resultant nickel content in the filtered oil are given in Table VI below. The relatively high residual nickel contents in the last two experiments are caused by the small amounts of bleaching earth that are used, because of which the pre-coat formed too slowly, thus allowing nickel agglomerates to pass through the filter cloth.

TABLE VI

| % water added | % bleaching earth added | Ni (mg/kg) |
|---|---|---|
| 1.37 | 1.0 | 0.05 |
| 1.00 | 1.0 | 0.05 |
| 1.00 | 0.5 | 0.05 |
| 0.87 | 0.5 | 0.4 |
| 0.50 | 0.5 | 0.3 |
| 0.57 | 0.2 | 4 |
| 0.47 | 0.1 | 5 |

EXAMPLE 9

Using samples of fish oil from the same batch as that employed in Example 5, a series of experiments was performed to illustrate the effect of the water present and the option that it may be weakly acidic. The procedure employed in Example 5 was followed for the first sample. For the second sample the procedure of Example 5 was followed, with the exception that the 1 wt. % water was replaced by 1 wt. % of a 10 wt. % aqueous solution of citric acid. For the third, comparative, sample no water or other aqueous solution was added. The results in terms of residual nickel content in the filtered oil are given in Table VII below.

TABLE VII

| Solution added | Ni (mg/kg) |
|---|---|
| 1 wt. % water | 0.05 |
| 1 wt. % of 10 wt. % citric acid | <0.02 |
| Nil | 0.6 |

EXAMPLE 10

The procedure described in Example 9 was performed on a fish oil having a nickel content of only 4 mg/kg. The results are given in Table VIII below.

TABLE VIII

| Solution added | Ni (mg/kg) |
|---|---|
| 1 wt. % water | 0.02 |
| 1 wt. % of 10 wt. % citric acid | <0.01 |
| Nil | 0.5 |

EXAMPLE 11

A series of experiments was carried out with rapeseed oil. The rapeseed oil was hydrogenated to a slip melting point of 32° C. using a nickel catalyst. The oil/catalyst slurry was filtered through a plate and frame filter. The filtered oil contained 2 ppm Ni.

The filtered oil was further refined according to the present process or in a conventional manner, as described in Examples 1, 2 and 3, except that 0.5 wt. % Tonsil ACC FF® bleaching earth was employed and that the deodorisation was carried out at 240° C. Each refining procedure was carried out twice. The averaged results are shown in Table IX.

Similar results were obtained when the deodorisation was carried out at 200° C. instead of at 240° C.

The series of experiments was repeated with two other batches of filtered hydrogenated rapeseed oil, containing 0.8 and 2 ppm residual nickel. Similar results were obtained.

TABLE IX

| Sample* | FFA+ (%) | Ni (ppm) | Taste score after 0 | 4 weeks | 8 weeks | 12 weeks |
|---|---|---|---|---|---|---|
| 1a | 0.35 | 2 | | | | |
| 1b | 0.42 | <0.02 | | | | |
| 1c | 0.02 | <0.02 | 7 | 6 | 6 | 6 |
| 2a | 0.34 | 2 | | | | |
| 2b | 0.35 | <0.02 | | | | |
| 2c | 0.02 | <0.02 | 7 | 5 | 6 | 6 |
| 3a | 0.36 | 2 | | | | |
| 3c | 0.02 | <0.02 | 7 | 6 | 6 | 6 |

*Sample 1 was treated with 1 wt. % of a 10% aqueous citric acid solution, sample 2 with 1 wt. % water and 3 indicates the comparative experiment, the sample being refined in a conventional manner, as described in Example 3. a indicates the crude filtered hydrogenated starting oil, b indicates the filtered bleached oil and c indicates the deodorised oil.
+FFA indicates free faty acid content.

EXAMPLE 12

Three batches of fish oil hydrogenated to a slip melting point of 37° C. were filtered and further refined using steam as aqueous substance.

The processes were carried out on factory scale in 40-ton vessels. Steam was passed through the crude filtered oil at 90° C. at a rate of 120 kg per hour until a moisture content of 2 wt % or 0.2 wt. then 0.25 wt. % Tonsil Standard FF® bleaching earth was admixed with the oil using a power input of 0.6 kW/ton and the oil was bleached and dried simultaneously for 30 minutes at 90° C. under reduced pressure. Subsequently, the oil was filtered over a plate and frame filter press. The oil that had passed through the filter before a sufficiently thick pre-coat had formed was recirculated into the vessel and filtered again. The results are shown in Table X.

TABLE X

| Starting oil Ni (ppm) | Starting oil FFA (%) | Steam added (%) | Denickeled oil Ni (ppm) | Denickeled oil FFA (%) |
|---|---|---|---|---|
| 8 | 0.2 | 2 | 0.04 | 0.2 |
| 16 | 0.3 | 2 | 0.03 | 0.2 |
| 5 | 0.1 | 0.2 | 0.1 | 0.1 |

EXAMPLE 13

Five batches of fish oil were hydrogenated with a nickel catalyst to a slip melting point of 35 or 41° C. The oil/catalyst slurry was pumped through a pipe to a plate and frame filter. Filtration of the entire batch of oil/catalyst slurry took about 3.5 hours. Each experiment was started with an empty filter, not yet containing a pre-coat. At the start of the filtration, steam was introduced into the slurry in the pipe between the pump and the filter. Samples of filtered oil were taken and analyzed for nickel and water contents, 3, 10 and 30 minutes after start of the steam introduction. When these samples had been taken, the steam was switched off and a further sample was taken after another 30 minutes. The results are shown in Table XI.

TABLE XI

| Batch | 1 | | 2 | | 3 | | 4 | | 5 | |
|---|---|---|---|---|---|---|---|---|---|---|
| smp of oil (°C.) | 41 | | 41 | | 35 | | 35 | | 35 | |
| time (min.) | Ni (ppm) | $H_2O$ (%) | Ni | $H_2O$ | Ni | $H_2O$ | Ni | $H_2O$ | Ni | $H_2O$ |
| 3 | 4 | 0.15 | 6 | 0.11 | 18 | 0.04 | 9 | 0.10 | 18 | 0.02 |
| 10 | 1.0 | 0.18 | 2 | 0.15 | 6 | 0.11 | 4 | 0.17 | 3 | 0.16 |
| 30 | 0.6 | 0.19 | 1 | 0.22 | 2 | 0.17 | 1 | 0.19 | 1 | 0.16 |
| 60 | 2 | 0.03 | 2 | 0.04 | 3 | 0.05 | 2 | 0.03 | 4 | 0.04 |

These experiments show that, after starting the introduction of steam into the oil/catalyst slurry before the filtration, the water content of the filtered oil rises gradually while the residual nickel content thereof decreases. After switching off the steam, the water content drops and the residual nickel content rises again.

EXAMPLE 14

7 kg filtered hydrogenated fish oil containing 3 ppm Ni and 0.01% water was heated to 90° C. 1% water was admixed and the dispersion was stirred for 20 minutes at a stirrer speed of 550 rpm. The dispersion was dried to a water content of 0.01% under vacuum. Subsequently, the dispersion was subjected to cross-flow microfiltration using a filter with pore diameter of 0.2μ at 60° C. The pressure before and after the filter were 2.2 and 1.6 bar, respectively, resulting in a filtration rate of 1 kg/hour. The nickel content of the filtration was 0.7 ppm, whereas the nickel content of the retentate was 6 ppm.

The experiment was repeated with three other batches of filtered hydrogenated fish oil, except that the oil was dried to a water content of 0.1% and that the amount and composition of the aqueous substance with which the starting oil was treated were varied. For comparison, the experiment was carried out two more times, except that no aqueous substance was added.

TABLE XII

| Ni content in starting oil (ppm) | Aqueous substance added | Water content of dried oil (%) | Ni content (ppm) in filtrate | Ni content (ppm) in retentate |
|---|---|---|---|---|
| 3 | 1% water | 0.01 | 0.7 | 6 |
| 3 | 1% water | 0.1 | 0.6 | 15 |
| 3 | 0.2% water | 0.1 | 0.4 | 16 |
| 4 | 0.2% aqueous citric acid solution (20%) | 0.1 | 0.1 | 7 |
| 5 | — | 0.01 | 1.5 | 5 |
| 4 | — | 0.01 | 1.5 | 6 |

EXAMPLE 15

A batch of 20 tonnes of neutralised, bleached and deodorised rapeseed oil, having a water content of 0.05 wt. %, was hydrogenated in a conventional manner in a stirred hydrogenation autoclave. A recycled nickel-on-silica catalyst was used in an amount of 0.3 wt. % (expressed as Ni-content on oil). The hydrogenation was stopped when the slip melting point of the oil had been raised to 41° C. The catalyst was removed from the oil by filtering the oil/catalyst slurry using a plate and frame filter. From the resulting batch of filtered hydrogenated oil, a sample was taken, which was analysed for nickel and water contents. Two further batches of the same rapeseed oil, of 20 tonnes each, were processed in the same way, except that simultaneously with the addition of the catalyst, in one of the batches of oil, 0.05 wt. % water was incorporated and in the other batch 0.1 wt. % water. No differences were observed between the three batches in the course of the hydrogenation reaction. These experiments were repeated three times. The averaged results regarding the water and nickel contents are shown in Table XIII.

TABLE XIII

| Batch | water added (%) | filtered oil: water content (%) | filtered oil: Ni content (ppm) |
|---|---|---|---|
| A | 0.05 | 0.01 | 1.3 |
| B | 0.1 | 0.01 | 0.5 |
| C | — | 0.01 | 2.1 |

EXAMPLE 16

20 tonnes of neutralised fish oil were hydrogenated in a stirring hydrogenation autoclave to a slip melting point of 37° C. with a recycled nickel-on-silica catalyst which was applied in an amount of 0.3% (expressed as Ni), calculated on the weight of the oil. After the hydrogenation had been stopped, the oil was cooled down while it was being kept in the hydrogenation autoclave. During the cooling 20 kg steam was introduced into the oil/catalyst slurry via an orifice plate in a period of about 30 minutes. During the cooling operation stirring of the slurry was continued. After the slurry had been cooled for about 45 minutes, the temperature had been reduced to about 120° C. Subsequently, the slurry was filtered to remove the catalyst and recover refined oil, using a plate and frame filter press. A sample was taken from the refined oil obtained and it was analysed for the water and residual nickel contents. For comparison the experiment was repeated without introducing steam during the cooling. The experiment was repeated three times. The averaged results are shown in Table XIV.

TABLE XIV

| Batch | water added (%) | filtered oil: water content (%) | filtered oil: Ni content (ppm) |
|---|---|---|---|
| A | 0.1 | 0.03 | 2.6 |
| B | — | 0.03 | 12 |

We claim:

1. Process for preparing refined oil comprising removing nickel, by incorporating into a crude edible oil an aqueous substance selected from water and steam in an effective amount to accomplish nickel agglomeration but no higher than 4%, forming with said aqueous substance and crude edible oil a dispersion containing water, nickel and oil, and maintaining said dispersion at a temperature from 60° C. to 220° C. and thereafter filtering the dispersion.

2. Process according to claim 1 wherein, the aqueous substance comprises at least 90 wt. % water.

3. Process according to claim 1, wherein the aqueous substance consists of water and edible acid.

4. Process according to claim 1, wherein 0.01–4% aqueous substance, calculated on the weight of the oil, is dispersed in the oil.

5. Process according to claim 1, wherein the amount of water dispersed in the oil is at least about equal to the solubility of water in the oil, but is less than 0.5% by weight of the oil above that solubility.

6. Process according to claims 1, wherein the crude oil comprises hydrogenated oil.

7. Process according to claim 6, wherein the hydrogenated oil comprises hydrogenated fish oil.

8. Process according to claim 6, wherein the crude oil is a filtrate obtained by filtering a slurry comprising hydrogenated oil and nickel catalyst.

9. Process according to claim 6, wherein the crude oil is a slurry comprising hydrogenated oil and nickel catalyst.

10. Process according to claim 1, comprising hydrogenating oil with the use of a nickel-containing catalyst, stopping the hydrogenation and recovering refined oil by filtering the slurry comprising hydrogenated oil and catalyst, wherein aqueous substance is incorporated in the crude oil before or during the hyrdrogenation.

11. Process according to claim 1, wherein the crude oil comprises 0.2–100 ppm nickel.

12. Process according to claim 8, wherein the aqueous substance that is contacted with the crude oil is steam.

13. Process according to claim 1, including, prior to filtering, admixing adsorbent with the dispersion.

14. Process according to claim 13, wherein the adsorbent comprises activated carbon.

15. Process according to claim 13, wherein the adsorbent comprises bleaching earth.

16. Process according to claim 1, including drying the dispersion including oil, nickel and water, to remove part of the water contained therein, prior to filtering.

17. Process according to claim 1, wherein the dispersion containing water, nickel and oil, that is filtered, contains no free water.

* * * * *